US008945346B2

(12) United States Patent
Bjoerkqvist et al.

(10) Patent No.: US 8,945,346 B2
(45) Date of Patent: Feb. 3, 2015

(54) METHOD AND AN APPARATUS FOR PRODUCING NANOCELLULOSE

(75) Inventors: Tomas Bjoerkqvist, Tampere (FI); Helmer Gustafsson, Kangasala (FI); Sirkka Gustafsson, legal representative, Kangasala (FI); Timo Koskinen, Valkeakoski (FI); Markus Nuopponen, Helsinki (FI); Annikki Vehniaeinen, Helsinki (FI)

(73) Assignee: Upm-Kymmene Corporation, Helsinki (FI)

( * ) Notice: Subject to any disclaimer, the term of this patent is extended or adjusted under 35 U.S.C. 154(b) by 0 days.

(21) Appl. No.: 13/977,794

(22) PCT Filed: Dec. 30, 2011

(86) PCT No.: PCT/FI2011/051174

§ 371 (c)(1),
(2), (4) Date: Nov. 13, 2013

(87) PCT Pub. No.: WO2012/089930

PCT Pub. Date: Jul. 5, 2012

(65) Prior Publication Data

US 2014/0083634 A1 Mar. 27, 2014

(30) Foreign Application Priority Data

Dec. 31, 2010 (FI) ..... 20106402

(51) Int. Cl.
*D21D 1/20* (2006.01)
*D21D 1/30* (2006.01)
(Continued)

(52) U.S. Cl.
CPC .. *D21B 1/12* (2013.01); *D21D 1/20* (2013.01); *D21D 1/22* (2013.01); *D21H 11/18* (2013.01)
USPC ..... 162/9; 162/28; 162/187; 162/261; 241/21; 241/28; 241/261.1; 241/261.2

(58) Field of Classification Search
CPC ..... D21B 1/12; D21D 1/20; D21D 1/22; D21D 1/30; D21H 11/18; B82Y 40/00; B82Y 99/00
USPC ..... 162/23–28, 234, 261, 9, 187; 241/20–21, 28, 220, 244, 246, 250, 241/261.1, 261.2
See application file for complete search history.

(56) References Cited

U.S. PATENT DOCUMENTS 2,778,282 A * 1/1957 Sutherland ..... 241/261.1
3,144,994 A * 8/1964 Danforth ..... 241/261.1
(Continued)

FOREIGN PATENT DOCUMENTS

CN 1665984 A 9/2005
CN 1711392 A 12/2005
(Continued)

OTHER PUBLICATIONS

May 7, 2012 Search Report issued in International Patent Application No. PCT/FI2011/051174.
(Continued)

*Primary Examiner* — Jose Fortuna
(74) *Attorney, Agent, or Firm* — Oliff PLC

(57) ABSTRACT

Described herein is nanocellulose produced by introducing a mixture of cellulose based fiber raw material and water through a refining gap, having a width smaller than 0.1 mm. In the refining gap, the fiber raw material is subjected to processing forces varying in the direction of introducing said mixture, by means of refining zones provided in the gap one after each other in the feeding direction, whereby the refining surfaces differ in surface patterning and/or surface roughness. The mixture of fiber raw material and water is guided past the refining surfaces in the feeding direction to different locations in the refining zone by by-pass channels provided in the stator. The width of the refining gap is maintained by the combined effect of the feeding pressure of the mixture of fiber raw material and water fed into the refining gap and the axial force of the rotor.

16 Claims, 2 Drawing Sheets

(51) Int. Cl.

| | |
|---|---|
| ***D21B 1/12*** | (2006.01) |
| ***D21D 1/22*** | (2006.01) |
| ***D21H 11/18*** | (2006.01) |

(56) References Cited

U.S. PATENT DOCUMENTS

| | | | | |
|---|---|---|---|---|
| 3,614,826 | A * | 10/1971 | Pilao | 29/434 |
| 4,374,702 | A | 2/1983 | Turbak et al. | |
| 4,381,217 | A | 4/1983 | Turkia | |
| 4,421,595 | A | 12/1983 | Huusari | |
| 5,354,005 | A * | 10/1994 | Mladota | 241/261.1 |
| 5,385,640 | A | 1/1995 | Weibel et al. | |
| 5,526,992 | A * | 6/1996 | Hawen et al. | 241/298 |
| 5,779,168 | A * | 7/1998 | Meltzer | 241/261.1 |
| 5,836,530 | A * | 11/1998 | Pilao | 241/261.1 |
| 6,183,596 | B1 | 2/2001 | Matsuda et al. | |
| 6,325,308 | B1 * | 12/2001 | Lofgren et al. | 241/28 |
| 6,402,071 | B1 * | 6/2002 | Gingras | 241/261.2 |
| 6,932,290 | B2 * | 8/2005 | Virving | 241/298 |
| 7,007,879 | B2 * | 3/2006 | Virving | 241/261.2 |
| 7,237,733 | B2 | 7/2007 | Vikman | |
| 7,300,540 | B2 * | 11/2007 | Sabourin et al. | 162/23 |
| 7,381,294 | B2 | 6/2008 | Suzuki et al. | |
| 7,713,381 | B2 * | 5/2010 | Sabourin et al. | 162/23 |
| 7,846,294 | B2 * | 12/2010 | Sabourin et al. | 162/23 |
| 2003/0071153 | A1 | 4/2003 | Aikawa | |
| 2003/0183712 | A1 * | 10/2003 | Virving | 241/296 |
| 2004/0118959 | A1 * | 6/2004 | Virving | 241/261.3 |
| 2006/0006264 | A1 * | 1/2006 | Sabourin et al. | 241/261.2 |
| 2008/0078854 | A1 * | 4/2008 | Sabourin et al. | 241/261.2 |
| 2008/0083520 | A1 * | 4/2008 | Sabourin et al. | 162/23 |
| 2009/0264036 | A1 | 10/2009 | Yano et al. | |
| 2013/0270377 | A1 * | 10/2013 | Gingras | 241/220 |
| 2013/0303749 | A1 * | 11/2013 | Vehniaeinen et al. | 536/56 |
| 2014/0083634 | A1 * | 3/2014 | Bjoerkqvist et al. | 162/28 |
| 2014/0284407 | A1 * | 9/2014 | Tamper et al. | 241/21 |

FOREIGN PATENT DOCUMENTS

| | | | | |
|---|---|---|---|---|
| DE | 3916393 | A1 | 11/1990 | |
| JP | A 2003-155349 | | 5/2003 | |
| SU | 1442584 | A1 | 7/1988 | |
| WO | WO 98/50623 | | 11/1998 | |
| WO | WO 2004/046455 | A1 | 6/2004 | |
| WO | WO 2010079263 | A2 * | 7/2010 | D21B 1/12 |
| WO | WO 2012089930 | A1 * | 7/2012 | |

OTHER PUBLICATIONS

Chinese Office Action dated Sep. 5, 2014 issued in Chinese Patent Application No. 201180063585.6 (with translation).

* cited by examiner

METHOD AND AN APPARATUS FOR PRODUCING NANOCELLULOSE

FIELD OF THE INVENTION

This invention relates to a method for producing nanocellulose, wherein cellulose based fibre raw material is processed mechanically to separate microfibrils. The invention also relates to an apparatus for producing nanocellulose.

BACKGROUND OF THE INVENTION

Mechanical pulp is produced industrially by grinding or refining wood raw material. In grinding, whole tree trunks are pressed against a rotating cylindrical surface, whose surface structure is formed to detach fibres from the wood. The obtained pulp is discharged with spraywaters from the grinder to fractionation, and the reject is refined in a disc refiner. This method produces pulp that contains short fibres and scatters light well. A typical example to be mentioned of a grinding process is U.S. Pat. No. 4,381,217. In the manufacture of refiner mechanical pulp, the starting material consists of wood chips which are guided to the centre of a disc refiner, from where they are transferred by the effect of a centrifugal force and a steam flow to the circumference of the refiner while being disintegrated by the blades on the surface of the disc. Typically, multi-phase refining is necessary for obtaining finished pulp in this process. The coarse fraction separated in the process can be directed into so-called reject refining. This method produces pulp with longer fibres compared to the above-described groundwood. Refining processes have been presented in, for example, publications WO-9850623, U.S. Pat. No. 4,421,595, and U.S. Pat. No. 7,237,733.

By said methods, mechanical pulp is produced, in which the fibres of wood raw material have been separated from each other and possibly refined further, depending on the energy used. By these methods, pulp is obtained in which the fibres fall within the dimensions of wood fibres, typically having a diameter greater than 20 μm. Fibre raw material with the same particle size can be obtained by preparing chemical pulp, that is, by processing the wood raw material chemically to separate the fibres. Cellulose containing fibre raw material obtained by mechanical or chemical pulping is commonly used for manufacturing paper or cardboard products.

Wood fibres can also be disintegrated into smaller parts by removing fibrils which act as components in the fibre walls, wherein the particles obtained become significantly smaller in size. The properties of so-called nanocellulose thus obtained differ significantly from the properties of normal cellulose. By using nanocellulose, it is possible to provide a product with, for example, better tensile strength, lower porosity and at least partial translucency, compared with using cellulose. Nanocellulose also differs from cellulose in its appearance, because nanocellulose is gel-like material in which the fibrils are present in a water dispersion. Because of the properties of nanocellulose, it has become a desired raw material, and products containing it would have several uses in industry, for example as an additive in various compositions.

Nanocellulose can be isolated as such directly from the fermentation process of some bacteria (including *Acetobacter xylinus*). However, in view of large-scale production of nanocellulose, the most promising potential raw material is raw material of plant origin and containing cellulose fibres, particularly wood. The production of nanocellulose from wood raw material requires the decomposition of the fibres further to the size class of fibrils. In processing, a cellulose fibre suspension is run several times through a homogenizing step that generates high shear forces in the material. For example in U.S. Pat. No. 4,374,702, this is achieved by guiding the suspension under high pressure repeatedly through a narrow opening where it achieves a high speed. In U.S. Pat. No. 5,385,640; U.S. Pat. No. 6,183,596; and U.S. Pat. No. 7,381,294; in turn, refiner discs are presented, between which a fibre suspension is fed several times.

In practice, the production of nanocellulose from cellulose fibres of the conventional size class can, at present, only be implemented by disc refiners of laboratory scale, which have been developed for the needs of food industry. This technique requires several refining runs in succession, for example 5 to 10 runs, to obtain the size class of nanocellulose. The method is also poorly scalable up to industrial scale.

SUMMARY OF THE INVENTION

It is an aim of the invention to present a method for preparing nanocellulose, in which there may be fewer refining runs and which can be implemented better also in a larger scale than the laboratory scale, for example in semi-industrial or industrial scale. To attain this purpose, the method according to the invention is primarily characterized in that

- the mechanical processing is performed by introducing a mixture of cellulose based fibre raw material and water at a low consistency of advantageously 1.5 to 4.5% and preferably 2 to 4% through a ring-shaped refining gap having a width smaller than 0.1 mm and formed between refining surfaces performing a relative movement in the direction of the periphery of the ring, an inner refining surface and an outer refining surface, the diameter of the gap increasing in the direction of feeding the mixture;
- in the refining gap, the fibre raw material is subjected to processing forces varying in the direction of introducing said mixture, by means of refining zones provided one after each other in the feeding direction in the gap, whereby the refining surfaces are different in their surface pattern and/or surface roughness;
- the mixture of fibre raw material and water is guided past the refining surfaces to different points of the refining zone in the feeding direction; and
- the width of the refining gap is maintained by the combined effect of the feeding pressure of the mixture of fibre raw material and water fed into the refining gap and the axial force of the inner refining surface.

In practice, the above-described method can be implemented in an apparatus of the type of a conical refiner, in which the ring-like refining gap is provided between the opposite refining surfaces expanding conically in the feeding direction. The inner refining surface of the refining gap is the outer surface of the rotating rotor expanding conically in the feeding direction, and its outer refining surface is the inner surface of the stator whose inner part expands conically in the feeding direction. Thus, the diameter of the narrow ring-like refining gap becomes wider in the direction of the rotating axis of the rotor.

With the conical shape, a long refining area is achieved in the feeding direction, whose length is determined on the basis of the cone angle and which can be divided in the feeding direction into successive zones in which the fibres are subjected to different types of processing. Similarly, the direction of the centrifugal force generated by the movement of the inner refining surface in the pulp is not the same as the direction of movement of the pulp between the inlet end and the outlet end; that is, the centrifugal force also presses the pulp to be processed towards the outer refining surface instead of moving the pulp in the longitudinal direction of the refining zone only. Advantageously, the refining zones become finer in the feeding direction, with respect to the surface pattern and/or roughness of the refining surface. In the feeding direction, there may initially be a blade patterning, and at the end, the mechanical effect on the fibre material is obtained by mere surface roughness. This can be implemented by means of hard particles attached to the surface and being similar to "grits" used in refining processes, which make up a uniform refining surface. Advantageously, the rough surface is formed on the refining surface by spraying a suitably hard material. The surface roughness provides a friction surface where the refining work is of "mangling" type.

As the mixture of cellulose based fibre raw material and water proceeds in such a refining gap, fibrils which form nanocellulose are separated from the fibres.

There may be two zones performing mangling work by means of surface roughness, a mixing zone being provided in between.

The setting of the refining gap plays an important role in the invention, because it has an effect on the refining result. The desired width of the refining gap is obtained by the combined effect of the pressure of the mixture of fibre raw material and water fed into the refining gap and the axial force of the inner refining surface. A particularly good alternative to keeping the refining gap constant is to apply a constant volume supply of the mixture into the refiner so that the volumetric flow remains constant irrespective of the feeding pressure. This can be achieved with fixed volume pumps of prior art, whose output is independent of the pressure.

BRIEF DESCRIPTION OF THE DRAWINGS

The invention will be described in the following with reference to the appended drawings, in which.

DETAILED DESCRIPTION OF THE INVENTION

In this application, nanocellulose refers to cellulose microfibrils or microfibril bundles separated from cellulose based fibre raw material. These microfibrils are characterized by a high aspect ratio (length/diameter): their length may exceed 1 μm, whereas the diameter typically remains smaller than 200 nm. The smallest microfibrils are in the size class of so-called elementary fibrils, where the diameter is typically 2 to 12 nm. The dimensions and size distribution of nanocellulose particles depend on the refining method and efficiency. Nanocellulose can be characterized as a cellulose based material, in which the median length of particles (fibrils or fibril bundles) is not greater than 10 μm, for example between 0.2 and 10 μm, advantageously not greater than 1 μm, and the particle diameter is smaller than 1 μm, suitably ranging from 2 nm to 200 nm. Nanocellulose is characterized by a large specific surface area and a strong ability to form hydrogen bonds. In water dispersion, nanocellulose typically appears as colourless, gel-like material. Depending on the fibre raw material, nanocellulose may also contain some hemicellulose. Often used parallel names for nanocellulose include nanofibrillated cellulose (NFC) and microfibrillated cellulose (MFC).

In this application, the term "refining" generally refers to comminuting material mechanically by work applied to the particles, which work may be grinding, crushing or shearing, or a combination of these, or another corresponding action that reduces the particle size. The energy taken by the refining work is normally expressed in terms of energy per processed raw material quantity, in units of e.g. kWh/kg, MWh/ton, or units proportional to these.

The refining is performed at a low consistency of the mixture of fibre raw material and water, the fibre suspension. Hereinbelow, the term pulp will also be used for the mixture of fibre raw material and water subjected to refining. The fibre raw material subjected to refining may refer to whole fibres, parts separated from them, fibril bundles, or fibrils, and typically the pulp is a mixture of such elements, in which the ratios between the components are dependent on the stage of refining.

Figure 1:
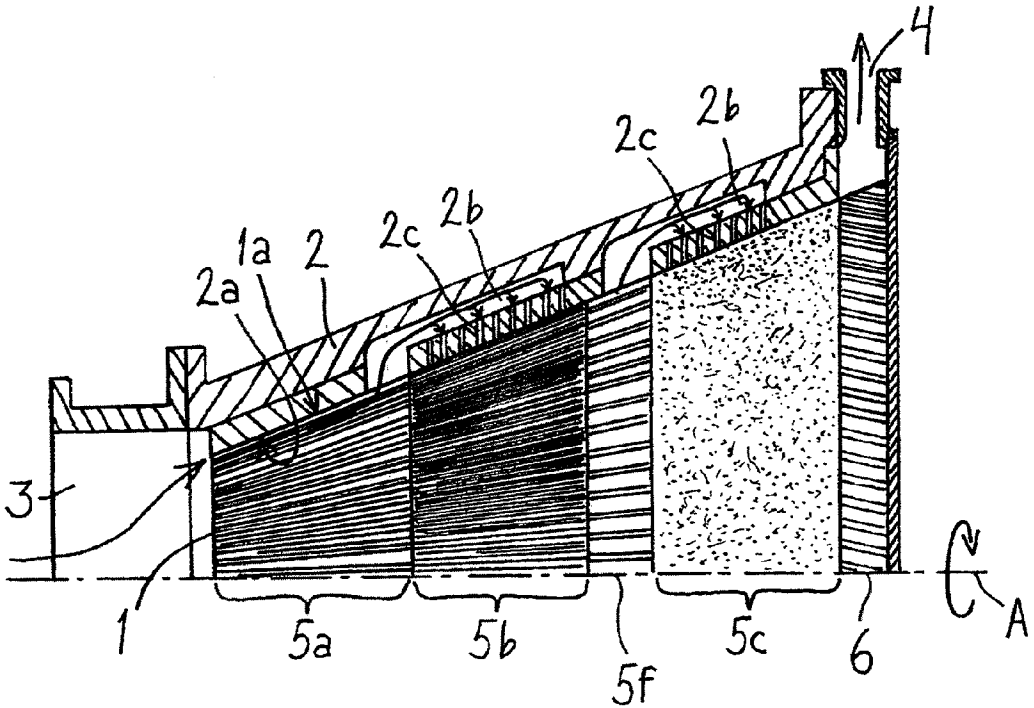
FIG. 1 shows an apparatus according to the invention, in a vertical cross-section in the direction of the rotation axis of the rotor.

FIG. 1 shows an apparatus in which the method according to the invention can be applied. The apparatus is a refiner operating by the principle of a conical refiner comprising a rotor 1 arranged to rotate with respect to a rotation axis A, and a fixed stator 2 surrounding the rotor. As to the structure of the rotor and the stator, only the part above the axis A is shown, because the structure is symmetrical with respect to the axis A. The rotor is rotated by an external power source, for example an electric motor (not shown). A ring-shaped refining gap is formed between the rotor and the stator, into which gap the fibre pulp to be processed is supplied at a suitable consistency from the first end of the refiner via an inlet opening 3 in the stator. The inner refining surface 1*a* of the refining gap consists of the outer surface of the rotor 1, and its outer refining surface 2*a* consists of the inner surface of the stator. The diameter of the ring-shaped refining gap increases in the direction of the rotation axis A of the rotor, seen from the first end of the refiner, because the rotor and the stator expand conically in this direction. The overall feeding direction of pulp supplied into the refiner coincides with the rotation axis A of the rotor, taking into account the fact that the pulp is carried in the refining gap through the refiner along a route in the shape of a conical mantle, whose central axis is formed by said axis A. The material refined in the refining gap exits through the outlet opening 4 of the stator at the second end of the refiner.

The refining gap constitutes a conically expanding refining area which extends in the longitudinal direction between the inlet opening 3 and the outlet opening 4, is concentric with the rotation axis A, and is divided into different zones in which the refining surfaces are different and the work on the fibres varies. In the figure, the zones are formed on the inner refining surface 1*a*, that is, the outer surface of the rotor 1. In the direction of the axis A, the surface pattern or surface roughness of the refining surface on at least two successive zones 5*a*, 5*b*, 5*c* is coarser in the first zone than in the subsequent zone. In FIG. 1, the first zone 5*a* is provided with a blade patterning, i.e. with grooves, between which edges are formed. The second zone 5*b* may also be provided with edges, but with a denser distribution, and the grooves may be lower. In the first zone, the width of the area or "tooth" between the grooves may be 5 to 10 mm and the depth of the grooves about 10 mm. In the second zone, the corresponding values may be about a half of these values. The first zone 5*a* may function as a preliminary refining zone for disintegrating fibre bundles in the supplied pulp and for homogenizing the pulp. The latter zone 5*b* may then function as a zone for reducing the fibre size by refining, although some refining work may take place already in the first zone.

In the teeth of the first and the second zone 5*a*, 5*b*, the edges facing the direction of rotation of the rotor are advantageously bevelled to form a wedge-like gap which opens in the direction of rotation and through which the fibre material enters the actual refining gap. The orientation of the teeth/edges is not essential, but it is possible to apply a pumping orientation in the zones, which means that the edges extend obliquely to the axis A (more precisely, to the projection of the axis A on the surface of the rotor) in such a way that a "pumping" effect is formed, moving the pulp forward in the refining gap when the rotor is rotating.

In the last zone 5*c*, the refining work is transmitted to the pulp refined in the preceding zones 5*a*, 5*b* by means of surface roughness. This surface roughness can be provided on the refining surface by a suitable coating method, such as a by coating the surface with hard particles. In this way, the refining surface becomes a kind of a friction surface which transmits refining energy to the pulp in the form of refining work of a mangling type. Such surfaces can be made, for example, by hot isostatic pressing (HIPping) of wear-proof granular material by using alloyed metal as adhesive, or by high speed spraying with corresponding components.

Such a friction surface well resistant to wear does not contain separate elevated grits which are known from various refining methods, but the whole surface is a wear-proof surface performing refining work and making—by means of the rotor movement and a similar friction surface on the opposite stationary stator—the cellulose fibre rotate flat in the refining gap, which brings about a continuous transformation in the fibre to decompose the cellulose fibre into fibrils. The friction of the surfaces should be sufficiently high to force the fibres to rotate, and to prevent their passage through the refining zone in merely compressed form and in the same position with respect to their longitudinal axis.

Instead of the last similar zone 5*c* it is also possible to provide two successive zones which are without edges (without a blade patterning) and are different in their surface roughness so that the surface roughness reduces in the feeding direction. Before this, correspondingly, two blade patterning zones 5*a*, 5*b* may be provided, as mentioned above, or only one blade patterning zone. Instead of two zones of different in surface roughnesses, it is also possible to use such a last zone 5*c*, in which the surface roughness decreases gradually from the initial end to the terminal end of the zone. However, in view of manufacturing techniques, the simplest way is to form an area with uniform properties.

The length and the quality of the zones can be selected according to the initial degree of refining of the pulp and the desired quality of the final product.

Successive refining zones 5*a*, 5*b*, 5*c* can be used in a sort of way to implement preliminary, intermediate and final refining in the same long refining gap, that is, in the refining area where pulp proceeds continuously from the feed end towards the discharge end.

The outer refining surface 2*a*, that is, the inner surface of the stator 2, is equipped with a suitable surface roughness. This can be done by the same coating methods as in the zones of the rotor. This surface roughness can be arranged to decrease in the longitudinal direction of the refining gap, for example by providing also the stator 1 with zones different in roughness.

FIG. 1 also shows an arrangement, by which the mixture of fibre raw material and water is guided past the refining surfaces to different points in the refining zone in the feeding direction. In this way, pulp can be distributed in the longitudinal direction of the refining gap without needing to convey all the pulp through the same refining gap determined by the inner refining surface 1*a* and the outer refining surface 2*a*; thus, the surface area of the refining surface or a single refining zone can be utilized more efficiently. In FIG. 1, the by-passes are arranged by means of channels 2*a*, 2*b* provided in the stator 2, for guiding and supplying at least part of the pulp to be processed farther away from the point where the pulp was transferred to the channel, in the longitudinal direction of the gap. The pulp is carried through a ring-shaped space surrounding the rotor to the actual main channel 2*b* that extends parallel to the casing of the rotor, and this channel may also be ring-shaped. In principle, the by-pass can be provided by means of a single channel whose terminal end opens to the refining gap, in the longitudinal direction of the refining gap, later than the initial end of the channel, where the pulp was introduced in the channel. The figure shows how inlet channels 2*c* branch towards the rotor 1 from the same main channel 2*b* of the stator 2 at two or more successive locations, for feeding the pulp flow taken from the refining gap and guided past it, back to the refining gap 1. In FIG. 1, this arrangement is provided for distributing pulp to both the second zone 5*b* and the third zone 5*c*, wherein it is taken into the channel always after the preceding zone 5*a*, 5*b*, respectively. At the terminal end of the channel or channels 2*b*, 2*c*, the movement of the refining surface 1*a* in the peripheral direction entrains the by-pass pulp back to the refining gap.

Although the figure shows how the channels can be used to take the pulp simultaneously across the boundaries of two successive zones (5*a*, 5*b*, and 5*b*, 5*c*), by-pass channels can also be provided so that they carry pulp to a different location within the same zone.

FIG. 1 also shows a way to avoid the phenomenon that water and fibres/fibrils are separated as the pulp proceeds in the refining gap. One or more mixing zones 5*f* are provided in the refining area to secure the remixing of the fibre material, that is, its remaining the fluidized state. Such a relatively short mixing zone 5*f* in the longitudinal direction of the refining area (shorter in the longitudinal direction of the refining area than the zone carrying out the actual refining work) is arranged, in the inner refining surface 1*a*, preferably before at least one zone performing mangling type refining by surface roughness (friction surface), in FIG. 1 at the boundary between the second and third zones 5*b*, 5*c*. Such a mixing zone may also be provided in the middle of such a zone, or at a boundary between two zones with different surface roughnesses. The mixing zone 5*f* consists of a suitable pattern made in the refining surface, which pattern, thanks to the movement of the rotor 1, mixes the pulp proceeding in the refining gap when it enters the zone. As shown in FIG. 1, it is advantageous that the pulp is mixed in this mixing zone 5*f* right before it is taken into the channels 2*a*, 2*b*; in other words, the mixing zone 5*f* begins right before the point of inlet of the pulp into the channel.

Figure 2:
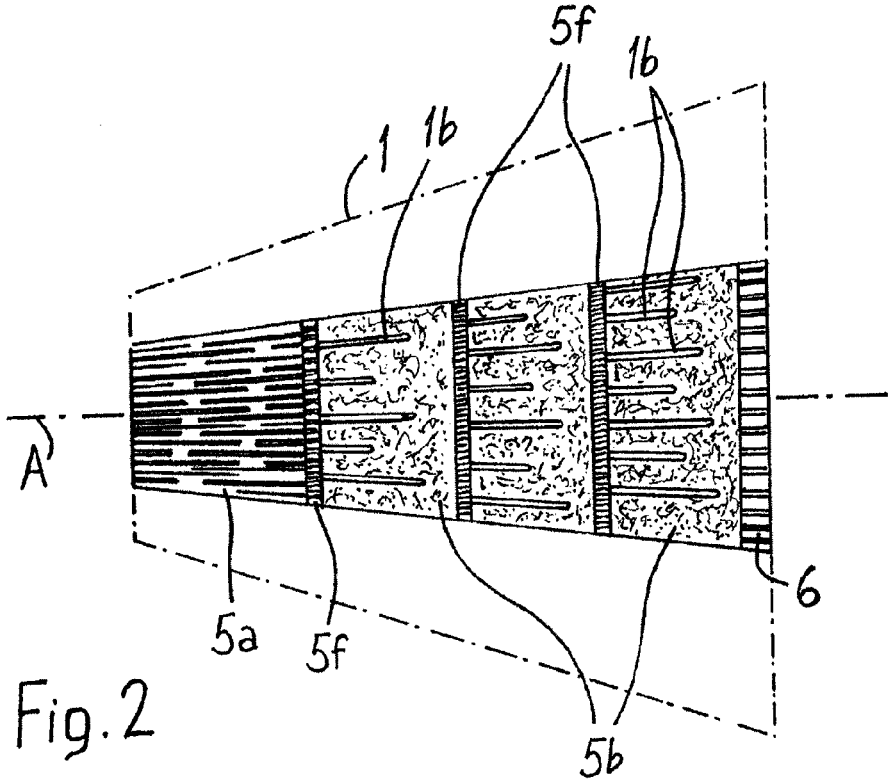
FIG. 2 shows an example of successive refining zones of the rotor as a top plan view.

FIG. 2 shows another structure by which the by-pass channels are arranged on the inner refining surface 1*a*. The by-pass channels of the refining surface are grooves 1*b*, that is, by-pass grooves, which have extension in the longitudinal direction of the refining area. In the way of the example of FIG. 1, the rotor is divided into zones in the longitudinal direction of the refining zone, of which the first zone 5*a* comprises an edge pattern and is intended for defibrillation. The second zone 5*b* comprises surface roughness and carries out mangling type refining as described above. The by-pass grooves begin at the end of the first zone 5*a* and end in the next zone 5*b*, and they may be different in length. From the by-pass grooves 1*b*, the pulp is passed in the side direction, by the effect of the rotary movement of the rotor 1, to the refining gap again, so that one by-pass groove is capable of distributing pulp to different locations in the pulp feeding direction, to a specific refining zone in the refining gap. The side edge (trailing edge) in the by-pass groove, opposite to the direction of rotation of the rotor, may be bevelled to facilitate the re-entry of the fibres in the refining gap.

Also, the rotor of FIG. 2 is provided with pulp mixing zones 5*f* at certain intervals in the longitudinal direction of the refining area. One zone is at the boundary between the first refining zone 5*a* and the second refining zone 5*b*, and one or more mixing zones 5*f* may be provided in the second refining zone 5*b*. Within the second refining zone 5*b*, more by-pass grooves 1*b* may be provided, beginning from the mixing zone 5*f* or before it. Also in this alternative, the mixing zones 5*f* are arranged to begin before the by-pass grooves 1*b*.

FIG. 2 may also be considered to illustrate a case, in which the inner refining surface 1*a* in the refining area is provided with two or more successive zones varying in surface roughness, wherein the mixing zone/zones 5*f* are placed at the boundaries of these.

At the wider terminal end of the rotor, at the outlet opening 4, a toothing or a corresponding structure is provided on the outer surface of the rotor 1 in a zone 6 of a given length, to force the aqueous pulp to the outlet 4, thanks to the centrifugal force generated by the rotating movement of the rotor (FIG. 1).

Figure 3:
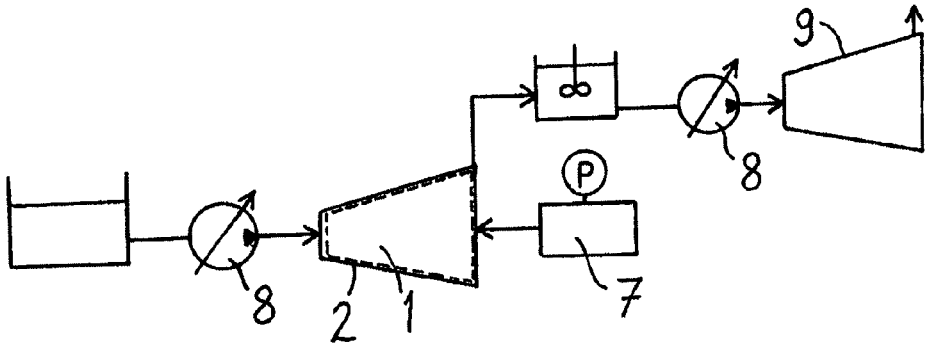
FIG. 3 illustrates the general principle of operation of the method according to the invention.

FIG. 3 shows schematically how a refining gap smaller than 0.1 mm can be set as desired during the refining process, taking into account that the refining surfaces in the process, in practice, touch each other but they must not be jammed. Therefore, the rotor and the stator of the refiner must here be understood as a kind of a lubricated slide bearing with conical sliding surfaces, where the pulp to be pumped between the sliding surfaces acts as a lubricant.

The refining gap between the rotor 1 and the stator 2 can be set as desired by the combined effect of the axial force of the rotor and the feed pressure of the mixture effective against this force. The axial loading force of the rotor, pushing the rotor 1 against the stator 2, is adjusted by an actuator 7, and the gap is maintained by the feed pressure generated by a feed pump 8 feeding pulp to the refining gap. The load generated by the actuator 7 can be based on the pressure of pressurized air or liquid, wherein the load can be measured directly by measuring the pressure of such a medium. The aim is to keep this pressure constant. The loading actuator 7 can be coupled to the rotating shaft of the rotor by known mechanical solutions for transmitting a linear movement to the shaft.

A fixed volume pump is advantageously used as the pump 8 for feeding pulp to the refiner. Such a pump produces a constant volumetric flow (volume of mixture per time) independent of the pressure. It is possible to use known fixed displacement pumps which are used on the principle of displacement, such as piston pumps and eccentric screw pumps. Thus, the pulp to be refined is, in a way, positively fed through the refiner (the refining gap). In this way, a homogeneous flow through the refining gap of the refiner is achieved, which flow is independent of fluctuations in the consistency and refining of the pulp, as well as a steady counterforce for the force tending to close the refining gap. The constant volumetric flow generated by the pump 8 is advantageously adjustable; that is, it can be set to a desired level, for example by changing the displacement volume.

Downstream of the refiner, post-refining can take place in a second refiner which is indicated by the reference numeral 9. The pulp from the first refiner can be pumped directly to the second refiner which is also a conical refiner where the structure of the refining surfaces of the rotor and the stator is the same as in the first refiner but where no zones with an blade patterning (edges) are needed; instead, all the refining work is performed by applying refining work of the mangling type, by friction generated by the surface roughness of the refining surfaces. However, at the initial end of the rotor, a mixing zone may be provided to secure sufficient fluidization of the pulp, and such mixing zones may also be provided downstream in the pulp feeding direction.

Between the first and second refiners, fractioning may be provided to separate larger particles from the mixture entering the second refiner 9 and to possibly return these particles to the starting mixture fed by the pump 8 to the first refiner.

In the invention, the pulp to be refined is a mixture of water and fibre material where the fibres have been separated from each other in the preceding manufacturing processes of mechanical pulp or chemical pulp, where the starting material is preferably wood raw material. In the manufacture of nanocellulose, it is also possible to use cellulose fibres from other plants, where cellulose fibrils are separable from the fibre structure. The suitable consistency of the low-consistency pulp to be refined is 1.5 to 4.5%, preferably 2 to 4% (weight/weight). The pulp is thus sufficiently dilute so that the starting material fibres can be supplied evenly and in sufficiently swollen form to open them up and to separate the fibrils.

The cellulose fibres of the pulp to be supplied may also be pre-processed enzymatically or chemically, for example to reduce the quantity of hemicellulose. Furthermore, the cellulose fibres may be chemically modified, wherein the cellulose molecules contain functional groups other than in the original cellulose. Such groups include, among others, carboxymethyl (CMC), aldehyde and/or carboxyl groups (cellulose obtained by N-oxyl mediated oxydation, for example "TEMPO"), or quaternary ammonium (cationic cellulose).

The invention claimed is:

1. A method for producing nanocellulose, wherein cellulose based fiber raw material is processed mechanically to separate microfibrils, wherein the mechanical processing is performed by feeding a mixture of cellulose based fiber raw material and water at a consistency ranging from 1.5 to 4.5% at a feeding pressure through a ring-shaped refining gap having a width smaller than 0.1 mm and formed between refining surfaces performing a relative movement in the direction of the periphery of the ring, an inner refining surface and an outer refining surface, the diameter of the ring-shaped gap becoming larger in the direction of feeding the mixture;

in the refining gap, the fiber raw material is subjected to processing forces varying in the direction of introducing said mixture, by means of refining zones provided one after each other in the feeding direction in the gap, whereby the refining surfaces differ in surface patterning and/or surface roughness;

part of the mixture of fiber raw material and water is guided past the refining surfaces in the feeding direction to different points of the refining zone; and the width of the refining gap is maintained by the combined effect of the feeding pressure of the mixture of fiber raw material and water fed into the refining gap and an axial force of the inner refining surface.

2. The method according to claim 1, wherein the refining zones become finer in the feeding direction, with respect to their surface patterning and/or roughness.

3. The method according to claim 1, wherein in at least one refining zone, the fibers are subjected to refining work of mangling type between friction surfaces accomplished by surface roughness.

4. The method according to claim 3, wherein maintenance of the mixture in fluidized state is secured by leading the mixture via a mixing zone before it is introduced between the friction surfaces accomplished by surface roughness.

5. The method according to claim 1, wherein formation of fiber flocks in the mixture is prevented by mixing produced by the first refining zone.

6. The method according to claim 1, wherein the mixture is guided past the refining surfaces to different locations in the refining zone via by-pass channels in a stator that forms the outer refining surface.

7. The method according to claim 1, wherein the mixture is guided past the refining surfaces to different locations in the refining zone via by-pass grooves in a rotor that forms the inner refining surface.

8. The method according to claim 1, wherein the mixture is supplied into the refining gap at a constant volumetric flow.

9. The method according to claim 1, wherein the mixture of cellulose based fiber raw material and water is at a consistency ranging from 2 to 4%.

10. An apparatus for producing nanocellulose, comprising a refining gap limited by refining surfaces, and a feeding device arranged to supply a mixture of cellulose based fiber raw material and water at a consistency ranging from 1.5 to 4.5% at a feed pressure to the refining gap, wherein the apparatus comprises a ring-shaped refining gap having a width smaller than 0.1 mm and formed between the refining surfaces carrying out a relative movement in the peripheral direction of the ring, an inner refining surface and an outer refining surface, the diameter of the ring-shaped gap expanding in the feeding direction of the mixture;

refining zones arranged one after the other in the feeding direction in the gap, where the refining surfaces differ in their surface patterning and/or surface roughness;

channels configured to guide part of the mixture of fiber raw material and water past the refining surfaces to different locations in the refining zone in the feeding direction; and an actuator for generating an axial force of the inner refining surface and for maintaining the width of the refining gap by the combined effect of the feed pressure of the feeding device and the axial force of the inner refining surface.

11. The apparatus according to claim 10, wherein it is a refiner of the conical refiner type having a fixed stator whose inner surface, having the shape of a conical mantle, constitutes the outer refining surface of the refining gap, and a rotor arranged to rotate inside the stator and whose outer surface having the shape of a conical mantle constitutes the inner refining surface of the refining gap.

12. The apparatus according to claim 10, wherein the refining zones become finer in their surface patterning and/or roughness in the direction of increasing the diameter of the refining gap.

13. The apparatus according to claim 10, wherein in at least one refining zone, the refining surfaces are friction surfaces provided with surface roughness, for performing refining work of mangling type on the fibers.

14. The apparatus according to claim 10, wherein a stator forming the outer refining surface is provided with by-pass channels configured to guide the mixture past the refining surfaces in the feeding direction of the mixture to different locations in the refining zone.

15. The apparatus according to claim 10, wherein a rotor forming the inner refining surface is provided with by-pass grooves configured to guide the mixture past the refining surfaces in the feeding direction of the mixture to different locations in the refining zone.

16. The apparatus according to claim 10, wherein the feeding device is a fixed volume pump.

* * * * *